US010138536B2

(12) United States Patent
Nakajima et al.

(10) Patent No.: US 10,138,536 B2
(45) **Date of Patent: *Nov. 27, 2018**

(54) HIGH-STRENGTH HOT-ROLLED STEEL SHEET AND METHOD FOR PRODUCING SAME

(71) Applicant: JFE STEEL CORPORATION, Chiyoda-ku, Tokyo (JP)

(72) Inventors: Katsumi Nakajima, Kawasaki (JP); Hayato Saito, Fukuyama (JP); Yoshimasa Funakawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 1022 days.

This patent is subject to a terminal disclaimer.

(21) Appl. No.: 14/370,330

(22) PCT Filed: Dec. 26, 2012

(86) PCT No.: PCT/JP2012/008320

§ 371 (c)(1),
(2) Date: Jul. 2, 2014

(87) PCT Pub. No.: WO2013/102988

PCT Pub. Date: Jul. 11, 2013

(65) Prior Publication Data

US 2014/0338801 A1 Nov. 20, 2014

(30) Foreign Application Priority Data

Jan. 6, 2012 (JP) ..... 2012-000912

(51) Int. Cl.
*C22C 38/28* (2006.01)
*C21D 8/02* (2006.01)
(Continued)

(52) U.S. Cl.
CPC ..... *C22C 38/28* (2013.01); *C21D 8/02* (2013.01); *C21D 8/0205* (2013.01);
(Continued)

(58) Field of Classification Search
CPC ... C22C 38/14; C22C 38/28; C21D 2211/002; C21D 8/02
(Continued)

(56) References Cited

U.S. PATENT DOCUMENTS 9,222,155 B2 * 12/2015 Nakamura ..... C21D 8/0226
2016/0060723 A1 * 3/2016 Yamazaki ..... C21D 8/02 148/602
(Continued)

FOREIGN PATENT DOCUMENTS

JP 2000109951 4/2000
JP 2000109951 A * 4/2000
(Continued)

OTHER PUBLICATIONS

Korean Office Action for Korean Application No. 20147021556, dated Apr. 18, 2016 with Concise Statement of Relevance of Office Action, 16 pages.
(Continued)

*Primary Examiner* — Weiping Zhu
(74) *Attorney, Agent, or Firm* — RatnerPrestia

(57) ABSTRACT

A high-strength hot-rolled steel sheet including a chemical composition containing, in percent by mass, 0.05% to 0.12% of C, 0.05% to 1.0% of Si, 0.5% to 1.8% of Mn, 0.04% or less of P, 0.0030% or less of S, 0.005% to 0.07% of Al, 0.006% or less of N, 0.05% to 0.15% of Ti, and the balance being Fe and incidental impurities, in which, in a region in the range of ⅛ to ⅜ of the sheet thickness, the content of Ti*, which is Ti existing as precipitates, is 0.3×[Ti] to 0.6×[Ti], where [Ti] is the Ti content, and the steel sheet has
(Continued)

a microstructure in which the area fraction of the bainite phase in the entire structure is more than 95%.

16 Claims, 1 Drawing Sheet

(51) Int. Cl.

| | |
|---|---|
| ***C21D 9/46*** | (2006.01) |
| ***C22C 38/14*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |
| ***C22C 38/08*** | (2006.01) |

(52) U.S. Cl.
CPC ..... *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/58* (2013.01); *C21D 8/0226* (2013.01); *C21D 2211/002* (2013.01); *C21D 2211/004* (2013.01)

(58) Field of Classification Search
USPC ..... 420/106
See application file for complete search history.

(56) References Cited

U.S. PATENT DOCUMENTS

2016/0076124 A1* 3/2016 Yamazaki ..... C21D 9/46
148/602
2016/0258032 A1* 9/2016 Nakajima ..... B32B 15/013

FOREIGN PATENT DOCUMENTS

| | | | |
|---|---|---|---|
| JP | 3219820 | B2 | 10/2001 |
| JP | 2005298956 | A | 10/2005 |
| JP | 2007-111708 | A | 5/2007 |
| JP | 4091894 | B2 | 5/2008 |
| JP | 2009-19265 | A | 1/2009 |
| JP | 2011-140671 | A | 7/2011 |
| JP | 2012-62562 | A | 3/2012 |

OTHER PUBLICATIONS

International Search Report dated Feb. 26, 2013, application No. PCT/JP2012/008320.
Final Office Action for U.S. Appl. No. 14/778,339, dated Nov. 14, 2017, 23 pages.
Restriction Requirement for U.S. Appl. No. 14/784,341, dated Jul. 26, 2017, 9 pages.
Restriction Requirment for U.S. Appl. No. 15/143,965, dated Aug. 2, 2017, 8 pages.
Final Office Action for U.S. Appl. No. 14/778,339, dated Apr. 27, 2018, 23 pages.

* cited by examiner

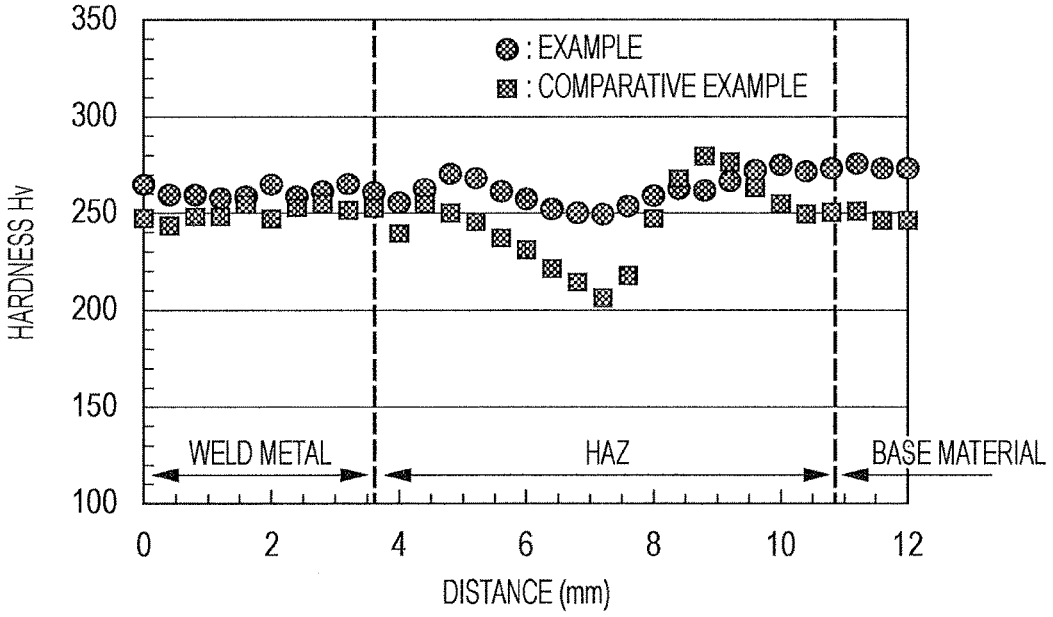
350
300
250
200
150
100
HARDNESS Hv
: EXAMPLE
: COMPARATIVE EXAMPLE
WELD METAL
HAZ
BASE MATERIAL
0
2
4
6
8
10
12
DISTANCE (mm)

HIGH-STRENGTH HOT-ROLLED STEEL SHEET AND METHOD FOR PRODUCING SAME

CROSS REFERENCE TO RELATED APPLICATIONS

This is the U.S. National Phase application of PCT/JP2012/008320, filed Dec. 26, 2012, which claims priority to Japanese Patent Application No. 2012-000912, filed Jan. 6, 2012, the disclosures of each of these applications being incorporated herein by reference in their entireties for all purposes.

FIELD OF THE INVENTION

The present invention relates to a high-strength hot-rolled steel sheet suitable for use in automotive structural parts, such as chassis parts and frames, in particular, a high-strength hot-rolled steel sheet with a tensile strength TS of 780 MPa or more having excellent welded joint characteristics, and a method for producing the same.

BACKGROUND OF THE INVENTION

In recent years, from the viewpoint of global environmental protection, improving fuel efficiency by reducing the weight of automobiles has been a global agenda. In order to achieve a reduction in the weight of automobiles, in addition to changes in the shape of structural parts, such as chassis parts and frames, it is necessary to increase the strength of steel sheets used therefore. In particular, use of high-strength hot-rolled steel sheets with a TS of 780 MPa or more has been anticipated. However, in general, as the strength of steel sheets is increased, properties, such as workability, become degraded. Accordingly, regarding high-strength hot-rolled steel sheets with a TS of 780 MPa or more, techniques have been proposed to improve workability, in particular, stretch-flange formability, weldability, and the like.

For example, Patent Literature 1 discloses a high-strength thin steel sheet having excellent hydrogen embrittlement resistance, weldability, and workability (hole-expandability), which contains, in percent by mass, 0.05% to 0.3% of C, 0.01% to 3.0% of Si, 0.01% to 4.0% of Mn, 0.0001% to 0.020% of P, 0.0001% to 0.020% of S, 0.01% to 0.23% of Al, 0.0001% to 0.01% of N, at least one of 0.001% to 5.5% of Ni, 0.001% to 3.0% of Cu, 0.001% to 5.0% of Cr, and 0.005% to 5% of Mo, and the balance being Fe and incidental impurities, which has a microstructure containing a main phase composed of 34% to 97% in total of one or both of bainite and bainitic ferrite, in terms of area fraction, a secondary phase composed of 3% to 30% of austenite, in terms of area fraction (Vγ), and the balance being ferrite and/or martensite, which has a TS of 800 MPa or more, and in which expressions (1-1) and (1-2) below are satisfied:

$$0 \leq 0.8\times\{2Cu+20Mo+3Ni+Cr\}-\{0.1-3.5\times10^{7}\times(TS)^{-3.1}\}-0.3V\gamma \quad (1\text{-}1)$$

$$0 \leq Si+Al+7.67C-1.78 \quad (1\text{-}2)$$

where TS is the tensile strength (MPa) and the symbols of elements represent the percentages of the respective elements contained in the steel.

Furthermore, Patent Literature 2 discloses a low-yield-ratio high-strength hot-rolled steel sheet having excellent workability (stretch-flange formability), fatigue properties, and spot weldability, which includes a composition containing, in percent by mass, 0.18% or less of C, 0.5% to 2.5% of Si, 0.5% to 2.5% of Mn, 0.05% or less of P, 0.02% or less of S, 0.01% to 0.1% of Al, one or two of 0.02% to 0.5% of Ti and 0.02% to 1.0% of Nb, the contents of Ti and Nb relative to C satisfying the expression C≥0.05+Ti/4+Nb/8, and the balance being Fe and incidental impurities, and whose structure includes ferrite and martensite containing a precipitated carbide of Ti and/or Nb or includes ferrite and martensite containing the precipitated carbide and retained austenite.

PATENT LITERATURE

PTL 1: Japanese Patent No. 4091894
PTL 2: Japanese Patent No. 3219820

SUMMARY OF THE INVENTION

In each of the high-strength thin (hot-rolled) steel sheets described in Patent Literatures 1 and 2, the strength of welded joints is much lower than the strength of the base material, and fracture is likely to occur in the welded joints. Thus, it is not possible to obtain excellent welded joint characteristics, which is a problem.

The present invention aims to provide a high-strength hot-rolled steel sheet with a TS of 780 MPa or more having excellent workability and welded joint characteristics and a method for producing the same.

The present inventors have performed thorough studies in order to achieve the object described above. As a result, it has been found that, in order to increase the strength of welded joints close to the strength of a base material, it is effective, in a region in the range of ⅛ to ⅜ of the sheet thickness, to make the structure of a steel sheet, which is the base material, to be mainly composed of the bainite phase by controlling the chemical composition, and to uniformize the structure and hardness of welded joints by securing a specific amount of Ti precipitates.

The present invention has been achieved on the basis of such findings and includes a high-strength hot-rolled steel sheet including a chemical composition containing, in percent by mass, 0.05% to 0.12% of C, 0.05% to 1.0% of Si, 0.5% to 1.8% of Mn, 0.04% or less of P, 0.0030% or less of S, 0.005% to 0.07% of Al, 0.006% or less of N, 0.05% to 0.15% of Ti, and the balance being Fe and incidental impurities, in which, in a region in the range of ⅛ to ⅜ of the sheet thickness, the content of Ti*, which is Ti existing as precipitates, is 0.3×[Ti] to 0.6×[Ti], where [Ti] is the Ti content, and the steel sheet has a microstructure in which the area fraction of the bainite phase in the entire structure is more than 95%.

In the high-strength hot-rolled steel sheet of the present invention, preferably, the chemical composition further contains, in percent by mass, at least one element selected from 0.005% to 0.1% of Nb and 0.005% to 0.1% of V; at least one element selected from 0.005% to 0.3% of Cr, 0.005% to 0.3% of Mo, 0.005% to 0.5% of Cu, and 0.005% to 0.5% of Ni; and at least one element selected from 0.0002% to 0.005% of B, 0.0005% to 0.02% of Ca and 0.0005% to 0.02% of REM, separately or simultaneously.

A high-strength hot-rolled steel sheet of the present invention can be produced by heating a steel slab including the chemical composition described above at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, in which cooling time in the temperature range from 650° C. to 550° C. is 2 to 5 s.

According to the present invention, it has become possible to produce a high-strength hot-rolled steel sheet with a TS of 780 MPa or more having excellent workability and welded joint characteristics. The high-strength hot-rolled steel sheet of the present invention is suitable for weight reduction not only in automotive structural parts, such as chassis parts and frames, but also in other machine structural parts.

BRIEF DESCRIPTION OF THE DRAWING

FIG. 1 is a graph showing a cross-section hardness profile of welded joints at a position of ¼ of the thickness of base materials.

DETAILED DESCRIPTION OF EMBODIMENTS OF THE INVENTION

The present invention will be described in detail below. Note that "%" representing the content of each component element means "percent by mass" unless otherwise indicated.

1) Chemical Composition

C: 0.05% to 0.12%

C is an element that increases the strength mainly by means of transformation toughening and also contributes to improvement in blanking workability by refining the bainite phase. In order to obtain such effects, it is preferred to set the C content at 0.05% or more. On the other hand, when the C content exceeds 0.12%, welded joint characteristics are markedly degraded. Therefore, the C content is set at 0.05% to 0.12%, and preferably 0.07% to 0.11%.

Si: 0.05% to 1.0%

Si is an element that stabilizes the strength by means of solid-solution strengthening and also contributes to improvement in ductility. In order to obtain such effects, it is preferred to set the Si content at 0.05% or more. On the other hand, when the Si content exceeds 1.0%, surface properties are degraded, and softening of the weld heat-affected zone (HAZ) is promoted, resulting in a large decrease in the strength of welded joints. Therefore, the Si content is set at 0.05% to 1.0%, and preferably 0.05% to 0.8%

Mn: 0.5% to 1.8%

Mn is an element that increases the strength mainly by means of transformation toughening. In order to obtain such an effect, it is preferred to set the Mn content at 0.5% or more. On the other hand, when the Mn content exceeds 1.8%, centerline segregation becomes marked, resulting in degradation in various characteristics, and significantly hardened portions are formed in the weld HAZ, thus largely decreasing the strength of welded joints. Therefore, the Mn content is set at 0.5% to 1.8%, and preferably 1.0% to 1.6%.

P: 0.04% or Less

P is an element that is segregated in the grain boundaries to adversely affect toughness of welded joints, and the like. Therefore, the P content is set at 0.04% or less, but is preferably decreased as much as possible. There is no problem even if the P content is 0 (zero).

S: 0.0030% or Less

S forms sulfides to degrade workability. Therefore, the S content is set at 0.0030% or less, but is preferably decreased as much as possible. There is no problem even if the S content is 0 (zero).

Al: 0.005% to 0.07%

Al is an element serving as a deoxidizer. In order to obtain such an effect, it is preferred to set the Al content at 0.005% or more. On the other hand, when the Al content exceeds 0.07%, toughness of welded joints is adversely affected. Therefore, the Al content is set at 0.005% to 0.07%, and preferably 0.015% to 0.05%.

N: 0.006% or Less

N forms coarse nitrides to degrade workability. Therefore, the N content is set at 0.006% or less, but is preferably decreased as much as possible. There is no problem even if the N content is 0 (zero).

Ti: 0.05% to 0.15%

Ti is the most important element in the present invention, and has a significant effect on bainite phase formation and uniformization of hardness of the weld HAZ. In order to obtain such effects, it is preferred to set the Ti content at 0.05% or more. On the other hand, when the Ti content exceeds 0.15%, toughness of welded joints is adversely affected. Therefore, the Ti content is set at 0.05% to 0.15%.

Ti*, which is Ti existing as precipitates, in a region in the range of ⅛ to ⅜ of the sheet thickness: 0.3×[Ti] to 0.6×[Ti], where [Ti] is the Ti content When the Ti* content is out of this range, the variation in hardness of the weld HAZ increases, and the strength of the welded joint becomes much lower than the strength of the base material. Therefore, the Ti* content is set to be 0.3×[Ti] to 0.6×[Ti].

Note that the Ti* content in a region in the range of ⅛ to ⅜ of the sheet thickness is measured by the method described below. First, a steel sheet is ground to remove a portion from the front surface at a position of ⅛ of the sheet thickness and a portion from the back surface at a position of ⅜ of the sheet thickness, thereby forming a sample of only a region in the range of ⅛ to ⅜ of the sheet thickness. The sample is subjected to electrolytic extraction with 10% AA (acetylacetone), the residue is subjected to alkali fusion, and by performing ICP measurement, the Ti* content in the region in the range of ⅛ to ⅜ of the sheet thickness is obtained. The Ti content [Ti] in a region in the range of ⅛ to ⅜ of the sheet thickness can be determined by subjecting a sample of only a region in the range of ⅛ to ⅜ of the thickness formed as described above to ordinary chemical analysis. However, the difference between the resulting value and the Ti content in a sample of a region in the whole range of thickness of the steel sheet is within an error of measurement. Therefore, the Ti content in the region in the whole range of thickness of the steel sheet may be defined as the Ti content [Ti] in a region in the range of ⅛ to ⅜ of the sheet thickness. The Ti precipitates described above mainly consist of Ti carbides, Ti nitrides, Ti sulfides, and complex precipitates thereof.

The balance is Fe and incidental impurities. However, for the reasons described below, it is preferable to incorporate into the composition, separately or simultaneously, at least one element selected from 0.005% to 0.1% of Nb and 0.005% to 0.1% of V, at least one element selected from 0.005% to 0.3% of Cr, 0.005% to 0.3% of Mo, 0.005% to 0.5% of Cu, and 0.005% to 0.5% of Ni, and at least one element selected from 0.0002% to 0.005% of B, 0.0005% to 0.02% of Ca and 0.0005% to 0.02% of REM.

At least one selected from 0.005% to 0.1% of Nb and 0.005% to 0.1% of V

These elements are each a carbonitride-forming element, and, similarly to Ti, have an effect on bainite phase formation and uniformization of hardness of the weld HAZ. In order to obtain such an effect, it is preferable to set the content of each element at 0.005% or more. On the other hand, when the content of each element exceeds 0.1%, such an effect is saturated, resulting in a rise in costs. Therefore, preferably, the Nb content is set at 0.005% to 0.1%, and the V content is set at 0.005% to 0.1%.

At least one selected from 0.005% to 0.3% of Cr, 0.005% to 0.3% of Mo, 0.005% to 0.5% of Cu, and 0.005% to 0.5% of Ni These elements have a function of improving hardenability, in particular, lower the bainite transformation temperature, and refine the bainite phase, thus contributing to improvement in blanking workability. In order to obtain such effects, it is preferable to set the content of each element at 0.005% or more. On the other hand, when the Cr content exceeds 0.3%, corrosion resistance is degraded. When the Mo content exceeds 0.3%, such effects are saturated, resulting in a rise in costs. Furthermore, when each of the Cu content and the Ni content exceeds 0.5%, surface defects are likely to occur during hot rolling. Therefore, preferably, the Cr content is set at 0.005% to 0.3%, the Mo content is set at 0.005% to 0.3%, the Cu content is set at 0.005% to 0.5%, and the Ni content is set at 0.005% to 0.5%. More preferably, the Cr content is 0.005% to 0.1%, the Mo content is 0.005% to 0.1%, the Cu content is 0.005% to 0.2%, and the Ni content is 0.005% to 0.2%.

B: 0.0002% to 0.005%

B is an element that is segregated in the grain boundaries and is useful in forming the bainite structure. In order to obtain such an effect, it is preferable to set the B content at 0.0002% or more. On the other hand, when the B content exceeds 0.005%, weld cracking is likely to occur. Therefore, the B content is preferably set at 0.0002% to 0.005%, and more preferably 0.0002% to 0.0025%.

At least one selected from 0.0005% to 0.02% of Ca and 0.0005% to 0.02% of REM

Ca and REM are each an element that is effective in controlling the shape of sulfides. In order to obtain such an effect, it is preferable to set the content of each element at 0.0005% or more. On the other hand, when the content of each element exceeds 0.02%, such an effect is saturated, resulting in a rise in costs. Therefore, it is preferable to set the Ca content to be 0.0005% to 0.02% and the REM content to be 0.0005% to 0.02%. More preferably, the content of each element is 0.0005% to 0.005%.

2) Microstructure

In addition to a TS of 780 MPa or more and excellent workability, in order to obtain excellent welded joint characteristics by uniformizing the hardness of the weld HAZ, it is preferred to control the Ti* content and to set the area fraction of the bainite phase in the entire structure to be more than 95% in a region in the range of ⅛ to ⅜ of the sheet thickness. The term "bainite phase" refers to the bainite phase and the bainitic ferrite phase. Furthermore, even in the case where the polygonal ferrite phase, the pearlite phase, the martensite phase, the retained austenite phase, and carbides are contained as phases other than the bainite phase, if the total content thereof is less than 5%, the advantageous effects of the present invention are not impaired.

Note that the area fraction of the bainite phase in the entire structure in a region in the range of ⅛ to ⅜ of the sheet thickness is determined as described below. A test specimen for a scanning electron microscope (SEM) is taken, a cross section in the thickness direction parallel to the rolling direction is polished and then etched with a 3% nital solution. SEM photographs are taken at a magnification of 3,000 times at five or more equally spaced positions in the thickness direction in the range of ⅛ to ⅜ of the sheet thickness, and the area of the bainite phase is determined by image analysis. The proportion (percentage) of the area of the bainite phase in the area of field of view observed is defined as the area fraction of the bainite phase.

3) Production Conditions

Heating temperature of steel slab: 1,150° C. to 1,300° C.

The heating temperature of the steel slab before hot rolling is very important in controlling the microstructure and precipitates. When the heating temperature is lower than 1,150° C., dissolution of carbonitrides precipitated in the steel slab becomes insufficient, and it is not possible to have intended effects of alloying elements. On the other hand, when the heating temperature exceeds 1,300° C., austenite grains coarsen during heating, the microstructure after hot rolling becomes non-uniform, and scale defects are likely to occur. Therefore, the heating temperature of the steel slab is set to be 1,150° C. to 1,300° C.

Hot rolling finishing temperature: $Ar_3$ transformation point to $Ar_3$ transformation point+100° C.

The steel slab which has been heated is subjected to hot rolling including rough rolling and finish rolling. When the hot rolling finishing temperature is lower than the $Ar_3$ transformation point, rolling is performed at a two-phase region temperature. Consequently, a coarse worked structure remains in the surface layer after hot rolling, workability is markedly degraded, and desired Ti precipitates cannot be obtained. On the other hand, when the hot rolling finishing temperature exceeds the $Ar_3$ transformation point+100° C., austenite grains are coarsened during hot rolling, a coarse bainite phase occurs in the surface layer in the end, workability is degraded, and desired Ti precipitates cannot be obtained in the subsequent cooling process. Therefore, the hot rolling finishing temperature is set to be the $Ar_3$ transformation point to the $Ar_3$ transformation point+100° C., and preferably the $Ar_3$ transformation point to the $Ar_3$ transformation point+75° C.

Cooling conditions after hot rolling: starting cooling within 2.0 s after the hot rolling, and performing coiling at a coiling temperature within 20 s after the hot rolling, in which cooling time in the temperature range from 650° C. to 550° C. is 2 to 5 s.

When cooling is started more than 2.0 s after the hot rolling, desired Ti precipitates cannot be obtained. Therefore, it is preferred to start cooling within 2.0 s.

Furthermore, when coiling is performed at the coiling temperature described below more than 20 s after the hot rolling, the area fraction of the bainite phase in the region in the range of ⅛ to ⅜ of the sheet thickness becomes 95% or less. Therefore, it is preferred to perform coiling at the coiling temperature within 20 s after the hot rolling.

Furthermore, when cooling time in the temperature range from 650° C. to 550° C. is less than 2 s, the Ti* content becomes out of the range of 0.3×[Ti] to 0.6×[Ti]. When the cooling time is more than 5 s, the pearlite phase is likely to be formed, resulting in degradation in workability. Therefore, it is preferred that cooling time in the temperature range from 650° C. to 550° C. is set to be 2 to 5 s.

Coiling Temperature: 350° C. to 550° C.

When the coiling temperature is lower than 350° C., the hard martensite phase is formed, and workability is markedly degraded. On the other hand, when the coiling temperature exceeds 550° C., the pearlite phase is likely to be formed, resulting in degradation in workability. Therefore, the coiling temperature is set to be 350° C. to 550° C., and preferably 375° C. to 525° C.

Regarding other production conditions, usual conditions may be employed. For example, a steel having a desired chemical composition is refined by a converter or the like, and then formed into a steel slab by a continuous casting process or the like. Furthermore, after hot rolling, the properties of the steel sheet are not changed even in the state in which scales are attached to the surface or in the state in which scales are removed by performing pickling. Furthermore, after hot rolling, it is also possible to perform temper rolling, hot dip galvanizing, electroplating, chemical conversion treatment, or the like.

The present invention is particularly effective in a hot-rolled steel sheet with a thickness of more than 4 mm. On the other hand, from the viewpoint of reducing the weight of parts, and further from the viewpoint of the quality of welded zones, the sheet thickness is preferably 10 mm or less, more preferably 8 mm or less, and still more preferably 7.0 mm or less.

Thus, it is possible to obtain a high-strength hot-rolled steel sheet with a TS of 780 MPa or more having excellent workability and welded joint characteristics. The criterion for having excellent welded joint characteristics is, for example, that the strength TS of a welded zone obtained by ordinary arc welding is 780 MPa or more. The strength of the welded zone can be measured by the method described in Examples.

The welding method is not particularly limited. In the field of the present invention, a typical example of the welding method is butt welding or fillet welding by arc welding. The atmosphere gas during welding is preferably $CO_2$ gas or mixed gas in which inert gas, such as Ar gas, is mixed with $CO_2$ gas (10% or more of $CO_2$ gas). The conditions, such as current, voltage, and the like, may be appropriately adjusted such that a welded zone (weld metal) with a desired size according to the purpose can be obtained. For example, reference can be made to JIS Z 3605 or the like. The welding speed may be appropriately set, but is preferably about 10 cm/min or more from the viewpoint of productivity. The welding wire (in particular, the composition of the wire) can be selected from known ones in accordance with the strength of the steel sheet. Furthermore, arc welding may be performed in combination with another means.

Examples

Steels Nos. A to J having chemical compositions shown in Table 1 were refined by a converter, and steel slabs were formed by a continuous casting process. The resulting steel slabs were formed into hot-rolled steel sheets Nos. 1 to 16 under the hot-rolling conditions shown in Table 2. In each case, cooling was started within 2.0 s after the hot rolling.

A test specimen for structure observation was taken from each of the resulting steel sheets, and the Ti* content and the area fraction of the bainite phase in a region in the range of ⅛ to ⅜ were obtained by the methods described above.

Furthermore, a JIS No. 5 tensile test specimen (in a direction perpendicular to the rolling direction) was taken, and a tensile test was carried out in accordance with JIS Z2241 to determine the yield strength YS, TS, and total elongation El.

Furthermore, using a welding wire MG50, arc welding was performed in 100% $CO_2$ gas at a welding speed of 60 cm/min, and the breaking strength of the welded joint, and in some steel sheets, the cross-section hardness profile of the welded joint corresponding to the position at ¼ of the sheet thickness of the base material were measured. Regarding the breaking strength of the welded joint, two test specimens were produced for each steel sheet such that the welded joint was located in the middle of the parallel portion of the test specimen, and the tensile direction was perpendicular to the rolling direction, and the average breaking strength was obtained. Furthermore, the hardness profile was determined at Hv500g over the weld metal-HAZ-base material at a pitch of 400 μm.

The results are shown in Table 3. In the examples of the present invention, the TS is 780 MPa or more, the El is 18.0% or more with a sheet thickness of 7 mm, and the breaking strength of the welded joint is 780 MPa or More, thus indicating that the steel sheets are high-strength hot-rolled steel sheets having excellent workability and welded joint characteristics. Furthermore, FIG. 1 shows a cross-section hardness profile of welded joints prepared using a steel sheet according of an example (Steel sheet No. 5 in Table 2) and a steel sheet of a comparative example (Steel sheet No. 8 in Table 2). In the example of the present invention, the difference in hardness between the HAZ and the base material is small at 45 Hv or less, indicating that the hardness of the welded joint is uniformized.

TABLE 1

(% by mass)

| Steel No. | C | Si | Mn | P | S | Ti | Al | N | Others | $Ar_3$ transformation point (° C.) | Remarks |
|---|---|---|---|---|---|---|---|---|---|---|---|
| A | 0.052 | 0.08 | 1.13 | 0.036 | 0.0019 | 0.123 | 0.066 | 0.0038 | Cu:0.29, Ni:0.39 | 856 | Within range of invention |
| B | 0.064 | 0.34 | 0.59 | 0.013 | 0.0028 | 0.148 | 0.048 | 0.0053 | Cr:0.29, REM:0.0025 | 880 | Within range of invention |
| C | 0.077 | 0.74 | 1.55 | 0.009 | 0.0022 | 0.093 | 0.019 | 0.0022 | Nb:0.008, Ca:0.0012 | 834 | Within range of invention |
| D | 0.091 | 0.68 | 1.39 | 0.027 | 0.0005 | 0.113 | 0.033 | 0.0044 | V:0.016, Ni:0.011 | 862 | Within range of invention |
| E | 0.109 | 0.89 | 1.79 | 0.017 | 0.0008 | 0.052 | 0.059 | 0.0031 | V:0.04, Nb:0.09, Cu:0.013 | 826 | Within range of invention |
| F | 0.119 | 0.77 | 1.44 | 0.006 | 0.0013 | 0.128 | 0.009 | 0.0010 | Mo:0.25 | 854 | Within range of invention |
| G | 0.121 | 0.75 | 1.43 | 0.006 | 0.0013 | 0.128 | 0.008 | 0.0010 | Mo:0.25, B:0.0005 | 848 | Within range of invention |
| H | 0.078 | 0.96 | 1.37 | 0.033 | 0.0027 | 0.179 | 0.041 | 0.0033 | — | 910 | Out of range of invention |
| I | 0.109 | 0.36 | 1.94 | 0.024 | 0.0019 | 0.131 | 0.067 | 0.0045 | — | 830 | Out of range of invention |

TABLE 1-continued

| Steel No. | C | Si | Mn | P | S | Ti | Al | N | Others | $Ar_3$ transformation point (° C.) | Remarks |
|---|---|---|---|---|---|---|---|---|---|---|---|
| | (% by mass) | | | | | | | | | | |
| J | 0.063 | 1.28 | 0.88 | 0.017 | 0.0012 | 0.088 | 0.027 | 0.0058 | — | 897 | Out of range of invention |

TABLE 2

| Hot-rolled steel sheet No. | Steel No. | Heating temperature (° C.) | Hot rolling finishing temperature (° C.) | Time until coiling after hot rolling (s) | Cooling time in temperature range from 650° C. to 550° C. (s) | Coiling temperature (° C.) | Sheet thickness (mm) | Remarks |
|---|---|---|---|---|---|---|---|---|
| 1 | A | 1120 | 875 | 12.9 | 2.4 | 525 | 3.2 | Comparative Example |
| 2 | A | 1195 | 865 | 10.3 | 2.1 | 475 | 3.2 | Example |
| 3 | A | 1285 | 890 | 12.2 | 2.9 | 305 | 3.2 | Comparative Example |
| 4 | B | 1265 | 890 | 18.7 | 4.8 | 455 | 7.0 | Example |
| 5 | C | 1280 | 890 | 17.5 | 2.9 | 425 | 7.0 | Example |
| 6 | C | 1295 | 980 | 15.5 | 3.5 | 370 | 6.0 | Comparative Example |
| 7 | C | 1285 | 870 | 17.8 | 1.8 | 425 | 6.0 | Comparative Example |
| 8 | C | 1290 | 895 | 22.5 | 6.5 | 535 | 7.0 | Comparative Example |
| 9 | D | 1245 | 880 | 14.2 | 3.0 | 485 | 3.2 | Example |
| 10 | D | 1240 | 875 | 17.1 | 5.5 | 540 | 6.0 | Comparative Example |
| 11 | E | 1270 | 850 | 19.5 | 4.1 | 395 | 7.0 | Example |
| 12 | F | 1290 | 875 | 16.3 | 3.8 | 365 | 6.0 | Example |
| 13 | G | 1290 | 875 | 17.1 | 4.0 | 365 | 6.0 | Example |
| 14 | H | 1225 | 925 | 18.8 | 4.9 | 385 | 7.0 | Comparative Example |
| 15 | I | 1285 | 875 | 12.6 | 2.7 | 435 | 3.2 | Comparative Example |
| 16 | J | 1290 | 930 | 14.4 | 4.8 | 545 | 3.2 | Comparative Example |

TABLE 3

| Hot-rolled steel sheet No. | Steel No. | Ti content in region in range of ⅛ to ⅜ of sheet thickness [Ti] (% by mass) | Ti* content in region in range of ⅛ to ⅜ of sheet thickness (% by mass) | Ti*/[Ti] | Area fraction of bainite phase in region in range of ⅛ to ⅜ of sheet thickness (%) | Tensile characteristic values of base material YS (MPa) | TS (MPa) | El (%) | Breaking strength of welded joint (MPa) | Remarks |
|---|---|---|---|---|---|---|---|---|---|---|
| 1 | A | 0.125 | 0.095 | 0.76 | 95.5 | 632 | 785 | 20.1 | 644 | Comparative Example |
| 2 | A | 0.124 | 0.049 | 0.40 | 96.5 | 660 | 798 | 23.5 | 795 | Example |
| 3 | A | 0.125 | 0.038 | 0.30 | 29.5 | 621 | 833 | 19.0 | 623 | Comparative Example |
| 4 | B | 0.149 | 0.073 | 0.49 | 97.0 | 690 | 822 | 26.5 | 820 | Example |
| 5 | C | 0.092 | 0.042 | 0.46 | 99.0 | 705 | 815 | 28.5 | 815 | Example |
| 6 | C | 0.094 | 0.035 | 0.37 | 44.0 | 702 | 865 | 17.5 | 660 | Comparative Example |
| 7 | C | 0.095 | 0.085 | 0.15 | 96.0 | 651 | 795 | 24.0 | 672 | Comparative Example |
| 8 | C | 0.095 | 0.044 | 0.89 | 31.0 | 613 | 722 | 22.5 | 669 | Comparative Example |
| 9 | D | 0.113 | 0.043 | 0.38 | 97.5 | 815 | 980 | 15.5 | 960 | Example |
| 10 | D | 0.114 | 0.082 | 0.72 | 56.0 | 599 | 761 | 18.3 | 724 | Comparative Example |
| 11 | E | 0.052 | 0.032 | 0.62 | 95.5 | 826 | 995 | 18.0 | 965 | Example |
| 12 | F | 0.127 | 0.059 | 0.46 | 97.5 | 774 | 875 | 19.5 | 870 | Example |

TABLE 3-continued

| Hot-rolled steel sheet No. | Steel No. | Ti content in region in range of 1/8 to 3/8 of sheet thickness [Ti] (% by mass) | Ti* content in region in range of 1/8 to 3/8 of sheet thickness (% by mass) | Ti*/[Ti] | Area fraction of bainite phase in region in range of 1/8 to 3/8 of sheet thickness (%) | Tensile characteristic values of base material YS (MPa) | TS (MPa) | El (%) | Breaking strength of welded joint (MPa) | Remarks |
|---|---|---|---|---|---|---|---|---|---|---|
| 13 | G | 0.126 | 0.063 | 0.50 | 98.3 | 784 | 860 | 19.0 | 888 | Example |
| 14 | H | 0.178 | 0.088 | 0.49 | 52.0 | 634 | 835 | 21.5 | 659 | Comparative Example |
| 15 | I | 0.131 | 0.041 | 0.31 | 33.0 | 681 | 874 | 19.5 | 672 | Comparative Example |
| 16 | J | 0.088 | 0.071 | 0.81 | 9.3 | 622 | 833 | 22.0 | 633 | Comparative Example |

The invention claimed is:

1. A high-strength hot-rolled steel sheet including a chemical composition comprising, in percent by mass, 0.05% to 0.12% of C, 0.05% to 1.0% of Si, 0.5% to 1.8% of Mn, 0.04% or less of P, 0.0030% or less of S, 0.005% to 0.07% of Al, 0.006% or less of N, 0.05% to 0.15% of Ti, and the balance being Fe and incidental impurities, wherein, in a region in the range of 1/8 to 3/8 of the sheet thickness, the content of Ti*, which is Ti existing as precipitates, is 0.3×[Ti] to 0.6×[Ti], where [Ti] is the Ti content, and a microstructure of the region in the range of 1/8 to 3/8 of the sheet thickness includes more than 95% of the bainite phase in terms of area fraction.

2. The high-strength hot-rolled steel sheet according to claim 1, wherein the chemical composition further comprises, in percent by mass, at least one element selected from 0.0005% to 0.02% of Ca and 0.0005% to 0.02% of REM.

3. The high-strength hot-rolled steel sheet according to claim 1, wherein the chemical composition further comprises, in percent by mass, 0.0002% to 0.005% of B.

4. The high-strength hot-rolled steel sheet according to claim 3, wherein the chemical composition further comprises, in percent by mass, at least one element selected from 0.0005% to 0.02% of Ca and 0.0005% to 0.02% of REM.

5. The high-strength hot-rolled steel sheet according to claim 1, wherein the chemical composition further comprises, in percent by mass, at least one element selected from 0.005% to 0.3% of Cr, 0.005% to 0.3% of Mo, 0.005% to 0.5% of Cu, and 0.005% to 0.5% of Ni.

6. The high-strength hot-rolled steel sheet according to claim 5, wherein the chemical composition further comprises, in percent by mass, 0.0002% to 0.005% of B.

7. The high-strength hot-rolled steel sheet according to claim 5, wherein the chemical composition further comprises, in percent by mass, at least one element selected from 0.0005% to 0.02% of Ca and 0.0005% to 0.02% of REM.

8. The high-strength hot-rolled steel sheet according to claim 1, wherein the chemical composition further comprises, in percent by mass, at least one element selected from 0.005% to 0.1% of Nb and 0.005% to 0.1% of V.

9. The high-strength hot-rolled steel sheet according to claim 8, wherein the chemical composition further comprises, in percent by mass, at least one element selected from 0.0005% to 0.02% of Ca and 0.0005% to 0.02% of REM.

10. The high-strength hot-rolled steel sheet according to claim 8, wherein the chemical composition further comprises, in percent by mass, 0.0002% to 0.005% of B.

11. The high-strength hot-rolled steel sheet according to claim 8, wherein the chemical composition further comprises, in percent by mass, at least one element selected from 0.005% to 0.3% of Cr, 0.005% to 0.3% of Mo, 0.005% to 0.5% of Cu, and 0.005% to 0.5% of Ni.

12. A method for producing a high-strength hot-rolled steel sheet comprising heating a steel slab including the chemical composition according to claim 1 at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, wherein cooling time in the temperature range from 650° C. to 550° C. is 2 to 5 s.

13. A method for producing a high-strength hot-rolled steel sheet comprising heating a steel slab including the chemical composition according to claim 2 at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, wherein cooling time in the temperature range from 650° C. to 550° C. is 2 to 5 s.

14. A method for producing a high-strength hot-rolled steel sheet comprising heating a steel slab including the chemical composition according to claim 3 at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, wherein cooling time in the temperature range from 650° C. to 550° C. is 2 to 5 s.

15. A method for producing a high-strength hot-rolled steel sheet comprising heating a steel slab including the chemical composition according to claim 5 at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, wherein cooling time in the temperature range from 650° C. to 550° C. is 2 to 5 s.

16. A method for producing a high-strength hot-rolled steel sheet comprising heating a steel slab including the chemical composition according to claim 8 at a heating temperature of 1,150° C. to 1,300° C., performing hot rolling at a hot rolling finishing temperature of the $Ar_3$ transformation point to the $Ar_3$ transformation point+100° C., starting cooling within 2.0 s after the hot rolling, and performing coiling at a coiling temperature of 350° C. to 550° C. within 20 s after the hot rolling, wherein cooling time in the temperature range from 650° C. to 550° C. is 2 to 5 s.

* * * * *